US008857092B2

(12) United States Patent
Bitsack

(10) Patent No.: US 8,857,092 B2
(45) Date of Patent: Oct. 14, 2014

(54) CHAMBER SAFETY DEVICE

(76) Inventor: Ned T. Bitsack, Merrimack, NH (US)

( * ) Notice: Subject to any disclaimer, the term of this patent is extended or adjusted under 35 U.S.C. 154(b) by 0 days.

(21) Appl. No.: 13/534,437

(22) Filed: Jun. 27, 2012

(65) Prior Publication Data

US 2013/0008070 A1 Jan. 10, 2013

Related U.S. Application Data

(60) Provisional application No. 61/590,019, filed on Jan. 24, 2012, provisional application No. 61/501,325, filed on Jun. 27, 2011.

(51) Int. Cl.
*F41A 17/44* (2006.01)
*F41A 29/04* (2006.01)

(52) U.S. Cl.
CPC ..... *F41A 17/44* (2013.01); *F41A 29/04* (2013.01)
USPC ..... 42/70.11

(58) Field of Classification Search
USPC ..... 42/70.11, 83, 96, 85, 70.01, 90, 95, 42/106; 89/30
See application file for complete search history.

(56) References Cited

U.S. PATENT DOCUMENTS 1,537,517 A * 5/1925 Wheeling ..... 42/96
2,997,802 A * 8/1961 Robbins ..... 42/70.11
3,018,576 A * 1/1962 Riechers ..... 42/70.11
4,084,340 A * 4/1978 Scudder ..... 42/96
5,669,252 A * 9/1997 Bentley ..... 70/14
6,470,615 B1 * 10/2002 Peterken ..... 42/70.01
6,804,906 B1 * 10/2004 Olsen ..... 42/70.11
7,891,129 B2 * 2/2011 Parry et al. ..... 42/96
8,191,301 B2 * 6/2012 Hatfield ..... 42/90

OTHER PUBLICATIONS

Dead Eye Supply website for Shotgun Saf-T-Plug, http://shop.deadeyesupply.com/Shotgun-Saf-T-Plug-SAF-Retail-l.htm Aug. 14, 2012.
TAPCO website for Chamber Safety Tool-Shotgun, http://www.tapco.com/products/index.php?_a=viewProd&productId=291, Aug. 14, 2012.
Chamber Safe website for Firearms Safety Product, http://www.chambersafe.com/index.html, Aug. 14, 2012.
Chamber Check website, http://www.chambercheck.com/pages/order-page, Aug. 14, 2012.

* cited by examiner

*Primary Examiner* — Michael Carone
*Assistant Examiner* — Reginald Tillman, Jr.
(74) *Attorney, Agent, or Firm* — Bourque and Associates, PA

(57) ABSTRACT

A chamber safety device is configured to be inserted into one or more loading/ejection port(s) of a weapon. When the chamber safety device is inserted into the one or more opening(s), the weapon is not capable of firing due to the fact that no bullet or shell can be inserted into the firing chamber and/or the weapon firing mechanism cannot come in contact with a bullet or shell located in the firing chamber. The chamber safety device includes an upper portion having at least top region which is preferably colored in a high visibility color, such as hunter orange, and which provides a visual indicator to the user and other people around the user that the weapon is not capable of firing. A lower portion is configured to be inserted into the one or more opening(s) of the weapon.

15 Claims, 3 Drawing Sheets

CHAMBER SAFETY DEVICE

CROSS-REFERENCE TO RELATED APPLICATIONS

This application claims priority from U.S. Provisional Patent No. 61/590,019 which was filed on Jan. 24, 2012 titled "Chamber Safety Device" and claims priority from U.S. Provisional Patent Application No. 61/501,325, which was filed on Jun. 27, 2011 and titled "Chamber Safety Device", both of which are incorporated fully herein by reference.

TECHNICAL FIELD

The present invention relates to safety devices for weapons and more particularly, relates to a device that is inserted into the chamber of a weapon, thereby insuring that no weapon shell or ammunition is in the chamber thereby preventing accidental firing of the weapon as well as providing a visual safety indicator that indicates that the chamber is empty and that the weapon cannot be fired.

BACKGROUND INFORMATION

Traditional manual load shot guns (as well as rifles) typically are provided in one of two types. The first type is an auto-loading weapon where the firing chamber is built into the side of the firearm and the firearm does not "break-open" while the second type is the break open weapon, where the barrel and firing chamber can be "broken" or opened, such that the weapon cannot be fired in that position.

Users of these weapons at public/private locations, such as gun clubs, shooting preserves, and other shooting locations, must walk around with their weapons either unloaded or broken open. Many shotgun versions, such as the autoloaders type including pump action shotguns, riot shotguns, lever action shotguns or other semi-automatic shotguns do not break open and therefore it is difficult or almost impossible to tell from a distance if the weapon is loaded and capable of firing or unloaded. As a result, these weapons are often not permitted at shooting locations because safety cannot be assured. These newer types of shotguns that do not break open are becoming increasingly popular among young, female and smaller stature shooters because of less recoil.

Users of a break-open style weapon typically walk around with their weapon in the "broken-open" position so that everyone can tell the weapon is either not loaded and/or not capable of firing. Keeping the weapon in an open state serves as the equivalent of engaging a safety mechanism on a weapon, but also gives the added assurance to people in view who can see the broken open position of the weapon, but who cannot visually see the safety engaged from a distance.

These break-action style double loading shotguns exist in two general subtypes. First, the traditional side-by-side shotgun, which features two barrels mounted one beside the other and second, the over and under shotgun, which features two barrels, with one mounted on top of the other. Both types have been used for both hunting and sporting purposes.

A loaded and ready to fire weapon is dangerous and accordingly, most shooting locations have specific rules that require that the weapon is unloaded and action opened when moving around the facility. For example, the facility may require that when not in the firing stand, that the action of the weapon must be open and empty. This can be easily and quickly accomplished and verified with traditional "break-open" shotgun models, whereby a user can unload and break open the weapon.

Accordingly, there is a need to find a way of using the new autoloader type of shotguns (rifles or other similar weapons) at shooting locations while also ensuring that everyone is aware that the gun cannot be fired. The solution should be cost effective, simple to use and serve as an obvious indicator that the weapon is not capable of being fired. Additionally, the solution should also be readily usable in more traditional shotguns that break open.

SUMMARY

The invention features a chamber safety device that comprises an upper portion with a length and a width, a lower portion with a length and a width, wherein the length of the lower portion is shorter than the length of the upper portion and wherein the width of the lower portion is narrower than the width of the upper portion, wherein the lower portion is configured to make a snug friction fit inside an opening of a weapon and the upper portion includes a top cover region. The opening of the weapon is a port through which bullets or shells are inserted and ejected.

The top cover region may be colored in a high visibility color. The top cover region may be colored a hunter orange color.

In the preferred embodiment, the chamber safety device is entirely molded as a single piece of material such as silicone. Silicone is somewhat resilient, easy to mold and EECO friendly. In another embodiment, the top cover region may be constructed from a hard plastic material. In all embodiments, the top cover region may extend beyond a top surface of the upper region in one or more directions, thereby creating a lip, wherein the lip is configured to allow a user to grip the chamber safety device for removal of the chamber safety device from the opening of the weapon and insertion of the chamber safety device into the opening of the weapon.

The upper portion may have a bulbous shape or a handle shape or a grip shape. In another embodiment, the upper portion may be constructed from a hard foam material.

In another embodiment, the lower portion may be constructed from a resilient foam material. The lower portion may include a material configured to retain a lubricant.

In another alternate embodiment of the present invention, a chamber safety device for a two opening weapon, the chamber safety device comprises an upper portion with a length and a width, wherein the upper portion includes a top cover region, a first lower portion connected to the upper portion and configured to make a snug or friction fit inside a first opening of a weapon and a second lower portion connected to the upper portion and configured to make a snug fit inside a second opening of a weapon, the second opening of the weapon disposed alongside and proximate the first opening. The first and second openings may be disposed side-by-side on the weapon or the first and second openings may be disposed one over the other on the weapon.

The first lower portion and the second lower portion may each include a bulbous or rounded shape. The first lower portion and the second lower portion may be constructed from one of the following: silicone (preferably) or alternatively from a resilient foam material, open cell foam, closed cell foam, rubber, or a composite material. The first lower portion and the second lower portion may include a material configured to absorb and retain a lubricant.

The upper portion may have a bulbous shape or a handle shape or a grip shape. The upper portion may be constructed from a hard foam material.

The top cover region may be colored in a hunter orange color or another high visibility color. The top cover region may be constructed from a hard plastic material. The top cover region may extend beyond a top surface of the upper region in one or more directions, thereby creating a lip, wherein the lip is configured to allow a user to grip the chamber safety device for removal of the chamber safety device from the openings of the weapon and insertion of the chamber safety device into the openings of the weapon.

It is important to note that the present invention is not intended to be limited to a system or method which must satisfy one or more of any stated objects or features of the invention. It is also important to note that the present invention is not limited to the preferred, exemplary, or primary embodiment(s) described herein. Modifications and substitutions by one of ordinary skill in the art are considered to be within the scope of the present invention.

BRIEF DESCRIPTION OF THE DRAWINGS

These and other features and advantages of the present invention will be better understood by reading the following detailed description, taken together with the drawings wherein.

DETAILED DESCRIPTION OF THE PREFERRED EMBODIMENTS

The present invention features a chamber safety device 10, FIGS. 1, 2, 3 and 4. The chamber safety device 10 is configured to be inserted into an opening 20 (120) (typically called a chamber) of a weapon 22 (122) such as, for example, a shot gun. The opening 20 (120) is the port through which bullets/shells are inserted and ejected. When the chamber safety device 10 of according to the present invention is inserted into the opening 20/120, the weapon is not capable of firing because no live round can be inserted into the weapon's firing chamber or if a live round has inadvertently been placed or left in the chamber due to advanced loading or a misfire, the chamber bolt (firing mechanism) cannot be moved into a firing position. Additionally, because of the coloration of at least the top-most exterior region or portion 18 (118) of the chamber safety device 10, the present invention provides a visual indicator to the user and other people around the user that the weapon is not capable of firing.

Figure 1:
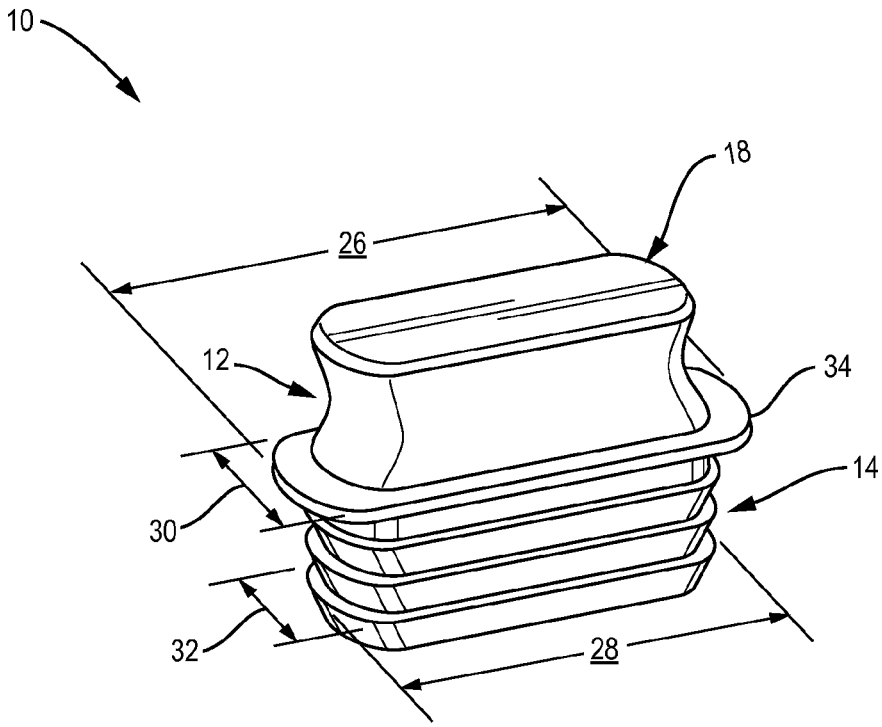
FIG. 1 is a plan view of the chamber safety device according to a first embodiment of the present invention.
Figure 2:
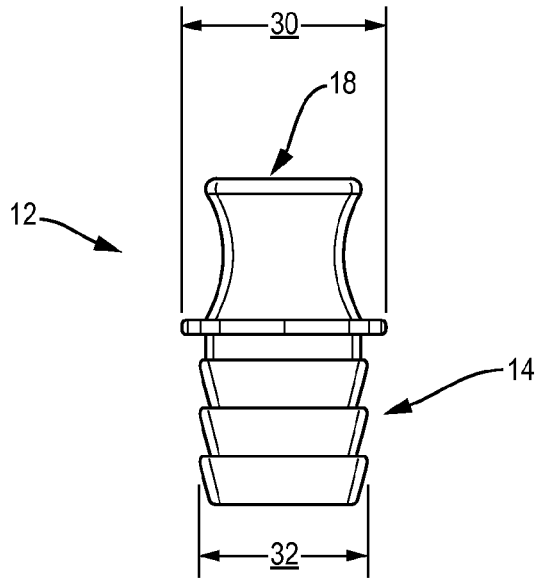
FIG. 2 is a detailed view of the width side of the chamber safety device according to a first embodiment of the present invention.
Figure 3:
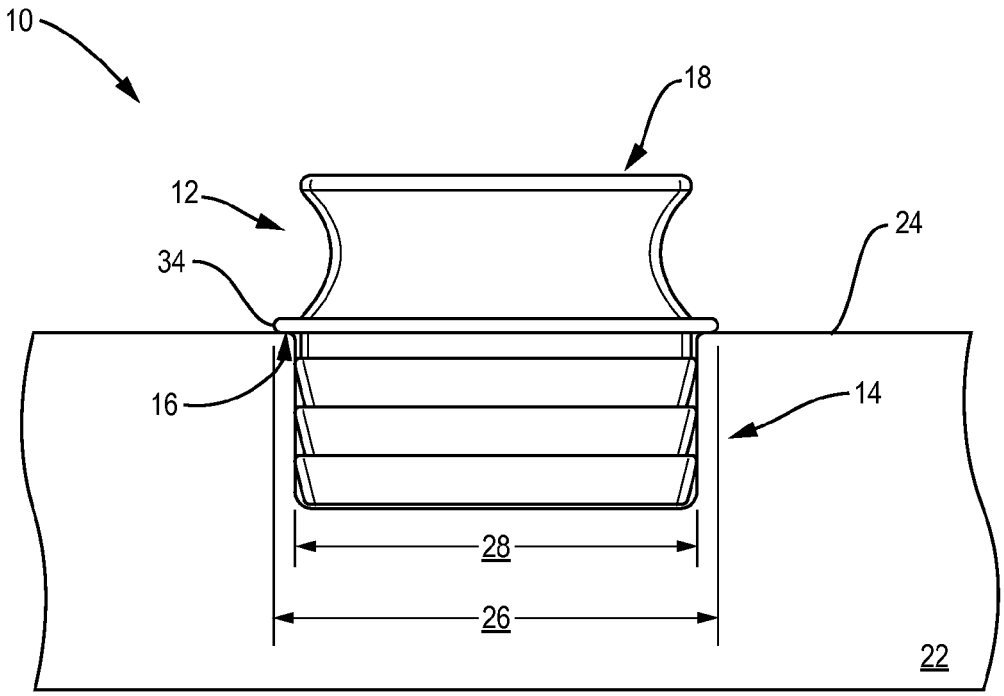
FIG. 3 is a cross-sectional side view of the length side of the chamber safety device in place in a weapon chamber according to the first embodiment of the present invention.
Figure 4:
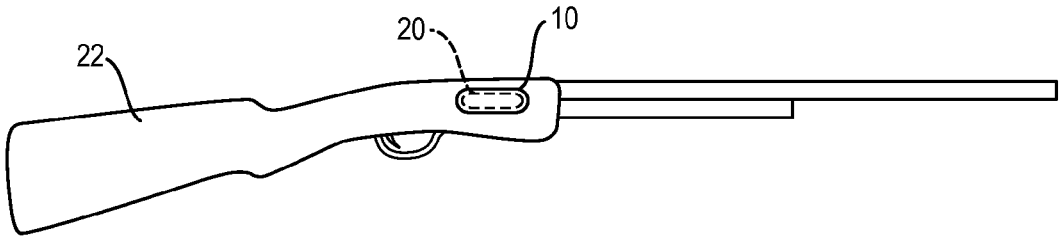
FIG. 4 is a side view of a chamber safety device in use on a shotgun according to a first embodiment of the present invention.

The chamber safety device 10 includes an upper portion 12 and a lower portion 14. The lower portion 14 preferably features a stepped (shown) or alternately a bulbous shape that is preferably configured in size to be slightly larger than the opening 20 in the weapon. In use, the larger size of the lower portion 14 in relation to the opening 20 allows for a snug and secure friction fit and retention of the lower portion 14 (and therefore the safety device 10) in the opening 20. The upper portion 12 may also feature a bulbous shape or may be more like a "handle" or "grip" shape as shown in FIG. 1.

Where the upper and lower portions 12/14 meet, the upper portion features a length 26 and a width 30 and the lower portion 14 features a length 28 and a width 32. The length 26 of the upper portion 12 is longer than the length of 28 of the lower portion 14. The width 30 of the upper portion 12 is wider than the width 32 of the lower portion 14. The greater length 26 and width 30 of the upper portion 12 prevents the upper portion 12 from entering into the opening 20. The larger length 26 and width 30 of the upper portion 12 also creates a lip 34 with a lower side 16 on the upper portion 12, which comes into contact with a top surface 24 of the weapon 22.

The upper and lower portions 12/14 are preferably constructed from one piece of material, such as silicone, or may be two separate portions that are adhered or otherwise connected to one another. At least the lower portion is preferably constructed from a generally resilient material, such as silicone or open or closed cell foam.

In the preferred embodiment, the top portion 12 is molded as one piece with the lower portion 14. In another embodiment, the upper portion may be constructed from a hard foam or other similar material that allows the chamber safety device 10 to be gripped and inserted and removed from the opening 20 of the weapon. In another embodiment, the upper portion may feature a separate top cover portion 18. The top cover portion 18 may be a separate hard plastic or other similar material. At least the top cover portion 18 is preferably "hunter" orange or another bright color that allows the top cover portion 18, which is exposed and visible when in use and in place in the opening 20 of the weapon, to be seen from a great distance. The top cover portion 18 is configured to cover a top surface of the upper portion and may extend beyond the top surface of the upper portion.

The upper portion 12 and/or the top cover portion 18 may feature one or more panels or flattened surface areas, which may feature a name, logo or other brand or marketing identifier. For example, the top cover portion 18 may feature one of these panels in a central part of an upper surface of the top cover portion 18. An etched or pronounced texture may surround the panel.

The material of the lower portion may feature a light texture. The lower portion 14 may also be coated with a lubricant. The material of the lower portion 14 provides a medium for the lubricant to be placed and retained for internal protection of the firearm chamber in wet weather conditions. The lubricant will both enable the lower portion 12 to move easily in and out of the opening 20 and will also serve to lubricate the inside of the opening (insertion and ejection port) 20 of the weapon 22.

When in use, lubricant on the lower portion 14 of the chamber safety device 10 also serves to prevent water and debris, such as dirt, from entering the opening 20 of the weapon 22 and from adhering to the chamber safety device 10, while also offering moisture protection in damp or moist weather conditions. The lubricant may be a typical gun lubricant. Lip 34 also serves to prevent water and debris, such as dirt, from entering the opening 20 of the weapon 22.

Figure 5:
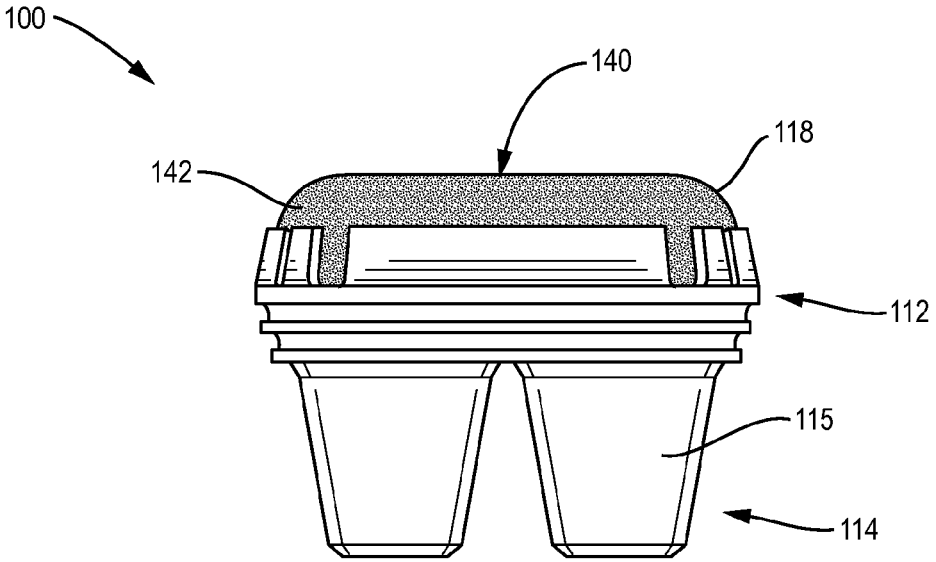
FIG. 5 is a detailed view of the chamber safety device according to a second embodiment of the present invention.
Figure 6:
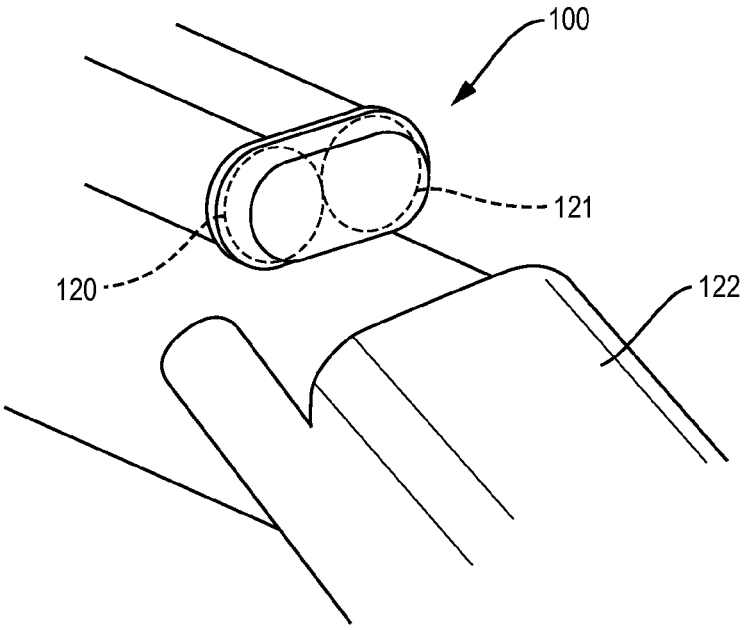
FIG. 6 is a view of the chamber safety device in a weapon chamber of a side-by-side break action shotgun according to the second embodiment of the present invention.

In another embodiment of the present invention as shown in FIGS. 5 and 6, the chamber safety device 100 is designed and configured for use in a break-action shotgun. The chamber safety device 100 can be inserted either horizontally in a side-by-side shotgun configuration (as shown in FIG. 5) or vertically in an over and under shotgun (not shown). The chamber safety device 100 provides an additional level of security above and beyond the shotgun being broken open, by providing a visual indication that the weapon does not contain ammunition and is not capable of firing.

In this second embodiment, the chamber safety device 100 is configured to be inserted into the two openings 120/121 of a weapon 122. When a break action shotgun is broken open, two ammunition compartments or openings 120/121 are exposed. When the chamber safety device 100 is inserted into the openings 120/121, the weapon 122 is not capable of firing because no live round can be inserted into the weapon's firing chamber. Additionally, because of the coloration of an exterior region or top cover portion 118 of the chamber safety device 100, the present invention provides a visual indicator to the user and other people around the user that the weapon is not capable of firing.

The chamber safety device 100 includes an upper portion 112 and two lower portions 114/115. The lower portions 114/115 feature a bulbous shape or round shape. The shape and size of each of the lower portions 114/115 is preferably configured in size to be slightly larger than each of the openings 120/121. In use, the larger size of the lower portions 114/115 in relation to the openings 120/121 allows for a snug and secure friction fit and retention of the lower portions 114/115 in the openings 120/121. The upper portion 112 may also feature a bulbous shape or may be more like a "handle" or "grip" shape. The upper portion 112 may feature a larger length and width than the combined length and width of the lower portions 114/115, as previously described in conjunction with the first embodiment of the present invention; however this is not intended to be a limitation of the present invention.

The upper portion 112 and lower portions 114/115 may be constructed from one piece of material or may be two or three or more separate portions that are adhered to one another. The lower portion 114/115 may be constructed from a generally resilient foam material, such as open or closed cell foam, or a rubber or other composite material. The material of the lower portion may feature light texture. The upper portion 112 and/or the top cover portion 118 may be constructed from a hard foam material or other similar material that allows the chamber safety device 100 to be gripped and inserted and removed from the openings 120/121 of the weapon 122. The upper portion may feature smooth surfaces. The top cover portion 118 may feature a separate hard plastic or other similar material. The top cover portion 118 is preferably "hunter" orange or another bright color that allows the top cover portion 118, which is exposed and visible when in use and in place in the openings 120/121 of the weapon, to be seen from a great distance. The top cover portion 118 may feature extended side portions (not shown) that extend lengthwise past the length of the upper portion 112, which facilitate removal of the chamber safety device 100 from the openings 120/121 by providing a grip surface. The lower portions 114/115 may also be coated in or impregnated with a lubricant.

The upper portion 112 and/or the top cover portion 118 may feature one or more panels or flattened surface areas 140, which may feature a logo or other identifier. For example, the top cover portion 18 may feature one of these panels 140 in a central part of an upper surface of the top cover portion 18. An etched or pronounced texture portion 142 may surround the panel.

Accordingly, the present invention provides a simple, inexpensive and easy to use device that functions to block the firing ability of shotgun and to provide an identifiable visual indicator to the user and others that the weapon is in a "safe" mode cannot be fired.

Modifications and substitutions by one of ordinary skill in the art are considered to be within the scope of the present invention, which is not to be limited except by the allowed claims and their legal equivalents.

The invention claimed is:

1. A chamber safety device for an opening in or proximate a breech in a weapon, said weapon including an action movable from an open non-armed position to a closed armed position, said chamber safety device comprising:

an upper portion having a length and a width, said upper portion configured for extending conspicuously out of and to the exterior of an opening of a weapon proximate a breech of said weapon, such that at least said upper portion remains continuously conspicuous to others in the area of said weapon proximate said breech when said chamber safety device is inserted into said opening in said weapon, wherein said upper portion has a shape selected from the group consisting of a bulbous shape, a handle shape and a grip shape, and wherein at least a top region of said upper portion is colored in a high visibility color, said high visibility color having a wavelength of greater than 492 nm; and a lower portion having a length and a width, wherein the upper portion and the lower portion are concentric, wherein the length of the lower portion is shorter than the length of the upper portion and wherein the width of the lower portion is narrower than the width of the upper portion, wherein the lower portion is configured for frictionally engaging with said opening of said weapon proximate said breech of said weapon, and wherein in use, said lower portion is configured for preventing said weapon action from moving from said open non-armed position to said closed armed position and for preventing a weapon ammunition round from being inserted into said breech.

2. The chamber safety device of claim 1, wherein said high visibility color is a hunter orange color.

3. The chamber safety device of claim 1, wherein at least said lower portion is constructed from a resilient material.

4. The chamber safety device of claim 1, wherein said chamber safety device is entirely constructed from a resilient material.

5. The chamber safety device of claim 4, wherein said resilient material is silicone.

6. The chamber safety device of claim 1, wherein at least said lower portion this constructed from a material configured to retain a lubricant.

7. The chamber safety device of claim 1, wherein said high visibility color is selected from the group consisting of green, yellow/green, yellow, orange and red.

8. A chamber safety device for a two opening weapon, said two openings in or proximate a breech in a weapon, said weapon including an action movable from an open non-armed position to a closed armed position, said chamber safety device comprising:

an upper portion having a length and a width, said upper portion configured for extending conspicuously out of and to the exterior of an opening of a weapon proximate a breech of said weapon, such that at least said upper portion remains continuously conspicuous to others in the area of said weapon proximate said breech when said chamber safety device is inserted into said opening in said weapon, wherein said upper portion has a shape selected from the group consisting of a bulbous shape, a handle shape and a grip shape, and wherein at least a top region of said upper portion is colored in a high visibility color, said high visibility color having a wavelength of greater than 492 nm; and a lower portion having a length and a width, wherein the upper portion and the lower portion are concentric, wherein the length of the lower portion is shorter than the length of the upper portion and wherein the width of the lower portion is narrower than the width of the upper portion, said lower portion including a first lower portion segment connected to said upper portion and configured to make a friction fit inside a first opening of a weapon, and a second lower portion segment connected to said upper portion and extending generally parallel to said first lower portion and configured to make a friction fit inside a second opening of a weapon, said second opening of said weapon disposed alongside and proximate said first opening, and wherein in use, said first and second lower portion segments are configured for preventing said weapon action from moving from said open non-armed position to said closed armed position and for preventing a weapon ammunition round from being inserted into said breech.

9. The chamber safety device of claim 8, wherein said first and second openings are disposed side-by-side on said weapon.

10. The chamber safety device of claim 8, wherein said first and second openings are disposed one over the other on said weapon.

11. The chamber safety device of claim 8, wherein said first lower portion segment and said second lower portion segment each include a bulbous or rounded shape.

12. The chamber safety device of claim 8, wherein said first lower portion segment and said second lower portion segment are constructed from a generally resilient material selected from the group consisting of silicone, a resilient foam material, an open cell foam, a closed cell foam, rubber, or a resilient composite material.

13. The chamber safety device of claim 8, wherein said first lower portion and said second lower portion are constructed from a material configured to retain a lubricant.

14. The chamber safety device of claim 1, wherein said lower portion includes a first lower portion segment connected to said upper portion and configured to make a friction fit inside a first opening of a weapon, and a second lower portion segment connected to said upper portion and extending generally parallel to said first lower portion segment and configured to make a friction fit inside a second opening of a weapon, said second opening of said weapon disposed alongside and proximate said first opening of said weapon.

15. The chamber safety device of claim 8, wherein said high visibility color is selected from the group consisting of green, yellow/green, yellow, orange and red.

* * * * *